US005462041A

United States Patent [19]

Solecki

[11] Patent Number: 5,462,041

[45] Date of Patent: Oct. 31, 1995

[54] ADJUSTABLE ARROW GUIDE

[76] Inventor: Dennis Solecki, 306 Dossenbach Dr., LaSalle, Ontario, Canada, N9J 3C4

[21] Appl. No.: 169,420

[22] Filed: Dec. 20, 1993

[51] Int. Cl.[6] ..... F41B 5/22

[52] U.S. Cl. ..... 124/44.5; 124/24.1

[58] Field of Search ..... 124/23.1, 24.1, 124/25.6, 44.5, 86, 87, 88

[56] References Cited

U.S. PATENT DOCUMENTS

| | | | |
|---|---|---|---|
| 3,285,237 | 11/1966 | Wolfe | 124/44.5 |
| 5,031,601 | 7/1991 | Gunter | 124/44.5 |
| 5,085,201 | 2/1992 | Tepper et al. | 124/44.5 |
| 5,181,502 | 1/1993 | Ray | 124/44.5 |
| 5,261,383 | 11/1993 | Halamay | 124/44.5 |

*Primary Examiner*—John A. Ricci

[57] ABSTRACT

An arrow guide comprising a first and a second guiding spool. Each guiding spool has a post and a head adapted to rotate about the post. Further provided is a hollow cylindrical locator which has a first sealed end and a second end. A pair of guiding holes extend through the locator with each guiding post disposed within a hole such that the heads of the guiding spools define an adjustable arrow-receiving guiding space therebetween. A tension spring is included. A first spring is positioned within the locator between the first end of the locator and bottom end of the first guiding post. A second spring is positioned within the locator between the bottom end of the guiding posts of the first and second spools. A third spring is positioned within the locator between the bottom leg of the second guiding post and the second end of the locator. Apparatus is provided for adjusting the tension on the springs for varying the guiding space. Apparatus is also provided for securing the bottom end of each post to the locator. Further provided is a guide holder for coupling the locator to a bow.

4 Claims, 5 Drawing Sheets

ADJUSTABLE ARROW GUIDE

BACKGROUND OF THE INVENTION

1. Field of the Invention

The present invention relates to an adjustable arrow guide and more particularly pertains to adjustable devices which may be used to more accurately guide arrows from a bow.

2. Description of the Prior Art

The use of arrow holding and guiding devices for bows is known in the prior art. More specifically, devices heretofore devised and utilized for the purpose of holding and guiding arrows are known to consist basically of familiar, expected and obvious structural configurations, notwithstanding the myriad of designs encompassed by the crowded prior art which have been developed for the fulfillment of countless objectives and requirements.

For example, horizontally adjustable arrow guides are illustrated in U.S. Pat. Nos. 5,052,364 to Martin; 5,070,855 to Troncosco; 4,881,515 to Simo; 4,119,078 to Wilson; and 266,179 to Peck.

While these devices fulfill their respective, particular objectives and requirements, the aforementioned patents do not describe an arrow guide capable of being adjusted both horizontally and vertically.

In this respect, the device according to the present invention substantially departs from the conventional concepts and designs of the prior art, and in so doing provides an apparatus primarily developed for the purpose of holding and guiding arrows.

Therefore, it can be appreciated that there exists a continuing need for new and improved arrow guide which can be horizontally and vertically adjusted. In this regard, the present invention substantially fulfills this need.

SUMMARY OF THE INVENTION

In view of the foregoing disadvantages inherent in the known types of devices for holding and guiding arrows now present in the prior art, the present invention provides a new and improved construction. As such, the general purpose of the present invention, which will be described subsequently in greater detail, is to provide a new and improved device for holding and guiding arrows which has all the advantages of the prior art and none of the disadvantages.

To attain this, the present invention essentially comprises a first and a second guiding spool. Each spool further comprises a post having a top end and a bottom end. Each post has a bend between the top end and the bottom end, with a top leg defined between the bend and the top end, and a bottom leg defined between the bend and the bottom end. The bottom leg forms an obtuse angle with the top leg and has a flat surface formed thereon. Each spool has a head. Each head further comprises a pulley, a nylon bearing rotatably coupling the pulley to the top end of the post, the nylon bearing adapted to facilitate smooth rotation of the pulley about the post with a minimum of friction and noise, and a rubber ring coupled about the pulley, the ring adapted to roll along the shaft of an arrow.

The guide includes a hollow and essentially cylindrical locator having an interior surface and an exterior surface, a first end, and a second end, the first end being sealed with an integral pin, the pin having a radial dimension less than that of the locator, the second end having threads formed on the interior surface and adapted for receiving a screw. A pair of guiding holes extends downward through the locator in a generally common direction, with the bottom leg of each guiding post disposed within a hole such that the bends formed on the posts of the guiding spool are facing each other, and the heads of the guiding spools are positioned above the locator to define an adjustable guiding space for an arrow therebetween. When an arrow is placed into the space and then propelled therefrom, the heads of the spools roll along the shaft of the arrow between the fletchings to guide it with a minimum of friction and noise.

A pair of threaded clamping holes is disposed on the locator, each hole positioned to be aligned with the flat surface of the bottom leg of each guiding post when the bottom leg is inserted through a guiding hole. A coupling hole is disposed on the locator near the pin, with the hole adapted to receive an end of a spring.

A first, second, and third tension spring are positioned within the locator, the first spring is positioned within the locator between the pin and bottom leg of the post of the first spool, the second spring positioned within the locator between the bottom leg of the post of the first spool and bottom leg of the post of the second spool, and the third spring positioned within the locator between the bottom leg of the post of the second spool and the second end of the locator. A set screw is disposed within the second end of the locator. The screw is adapted for adjusting the tension on the springs within the locator, whereby adjusting the screw allows the guiding space to become smaller or larger. The device includes a pair of clamping bolts, with each bolt disposed through a clamping hole to secure the flat surface of the bottom leg of each guiding post to the locator.

The device includes a guide holder, the holder further comprising a shaft having a first end and a second end, the first end having threads mounted therearound, the second end of the shaft forming a hollow cylinder having a radial dimension greater than that of the pin of the locator and having a hole disposed thereon, the hole adapted to receive an end of a spring. The device also includes a holding spring having a first end and a second end, the first end disposed in the coupling hole of the shaft, the second end disposed in the coupling hole of the locator, whereby urging the pin of the locator within the second end of the shaft and damping torsional movement of the locator. The device has a first nut secured to the second end of the shaft.

An elongated pivot arm having a first end and a second end is mounted to the shaft and secured with a second nut such that the arm is adjustably positioned between first and second nut. The first end of the arm has a hole disposed therethrough, with the hole adapted to be rotatably coupled to an archer's bow. By rotating the arm, the guiding space may move vertically, and by adjusting the first and second nuts, the guiding space may move horizontally, allowing an archer both horizontal and vertical control of the orientation of an arrow placed in the guiding space.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for holding and guiding arrows which has all the advantages of the prior art or devices of a similar nature and none of the disadvantages.

It is another object of the present invention to provide a new and improved device for holding and guiding arrows which may be easily and efficiently manufactured and marketed.

It is a further object of the present invention to provide a new and improved device for holding and guiding arrows which is of a durable and reliable construction.

An even further object of the present invention is to provide a new and improved device for holding and guiding arrows which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved device for holding and guiding arrows which provides in the apparatuses and methods of the prior art some of the advantages thereof, while simultaneously overcoming some of the disadvantages normally associated therewith.

Still another object of the present invention is to shoot arrows truer, quieter, and faster.

Yet another object of the present invention is to increase an archer's accuracy and enjoyment.

Even still another object of the present invention is to provide a new and improved arrow guide comprising a first and a second guiding spool each having a post, and a head adapted to rotate about the post; a hollow cylindrical locator having a first sealed end and a second end; a pair of guiding holes extending through the locator with each guiding post disposed within a hole such that the heads of the guiding spools define an adjustable arrow-receiving guiding space therebetween; tension spring including a first spring positioned within the locator between the first end of the locator and bottom end of the first guiding post, a second spring positioned within the locator between the bottom end of the guiding posts of the first and second spools, and a third spring positioned within the locator between the bottom leg of the second guiding post and the second end of the locator; means for adjusting the tension on the springs for varying the guiding space; and means for securing the bottom end of each post to the locator; and a guide holder for coupling the locator to a bow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
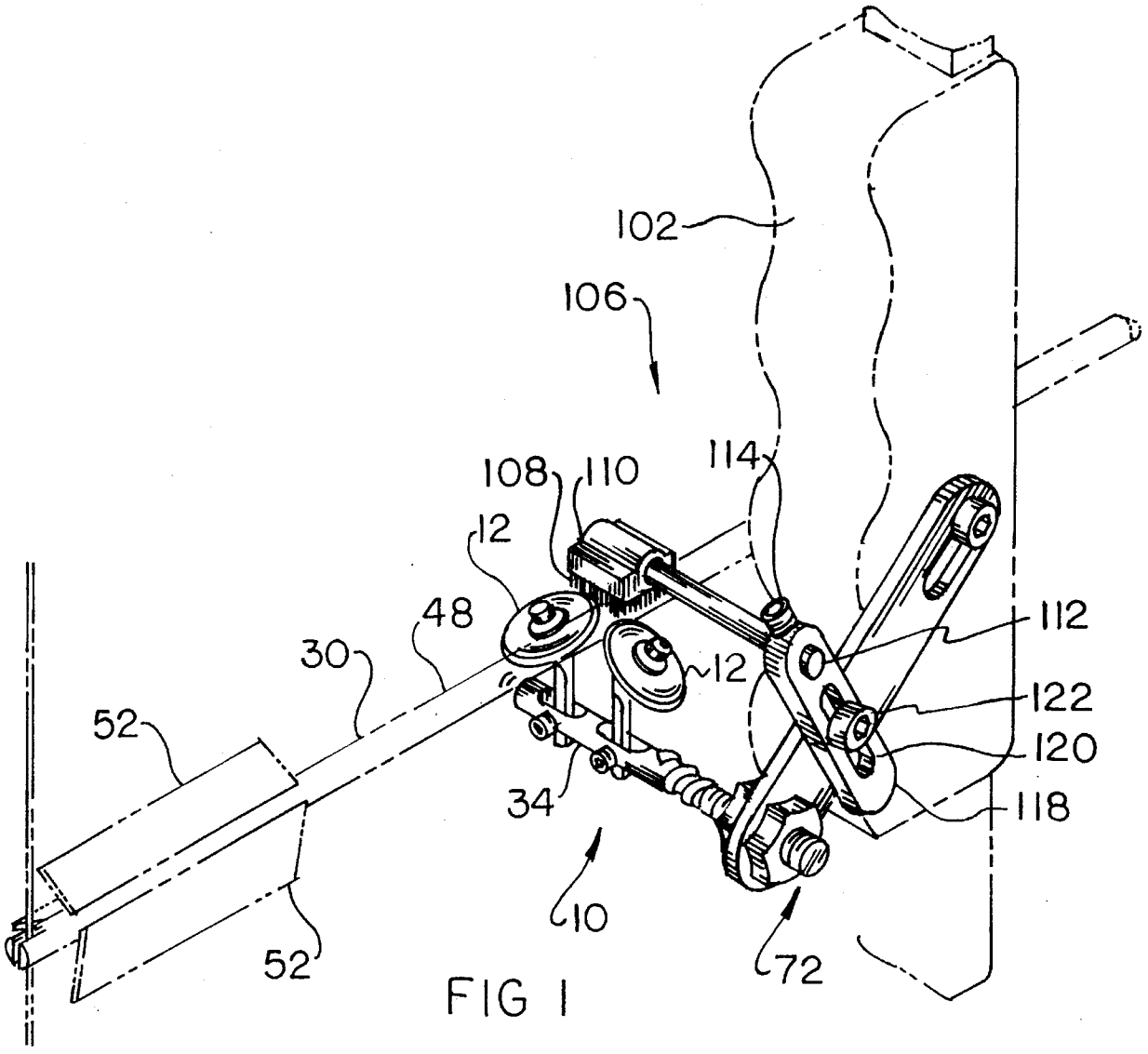
FIG. 1 is a perspective view illustrating the adjustable arrow guide constructed in accordance with the principles of the present invention and mounted on a bow.
Figure 2:
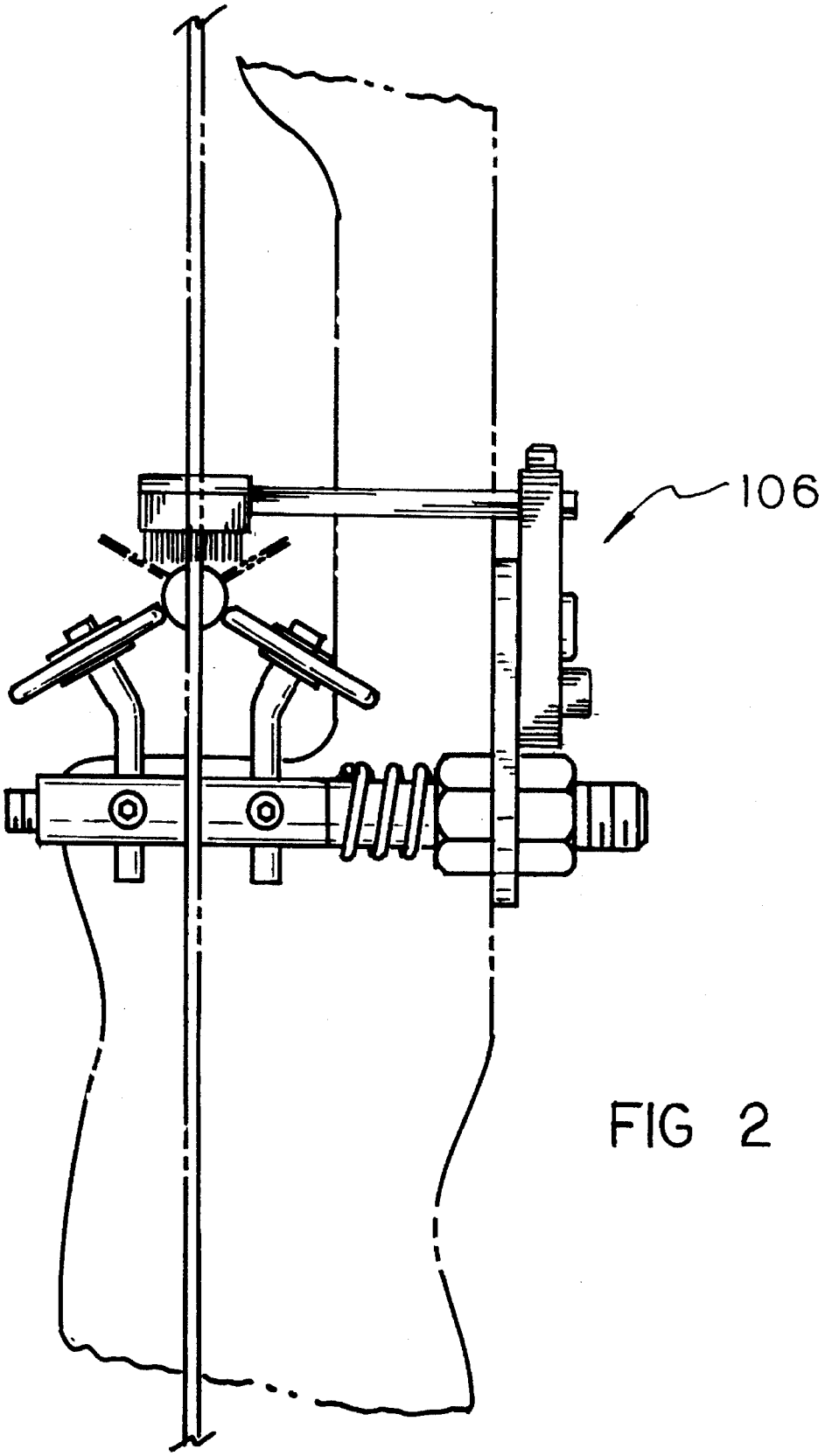
FIG. 2 is an end view of the apparatus shown in FIG. 1 looking down the axis of the arrow.
Figure 4:
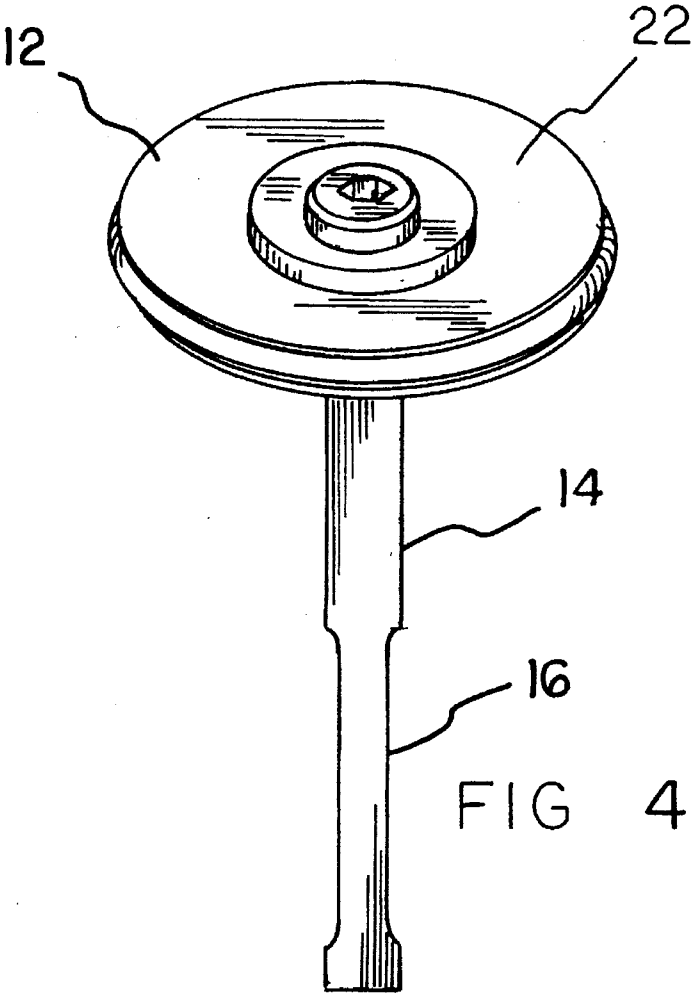
FIG. 4 is a front elevational view of the arrow guide spool of FIG. 3.
Figure 3:
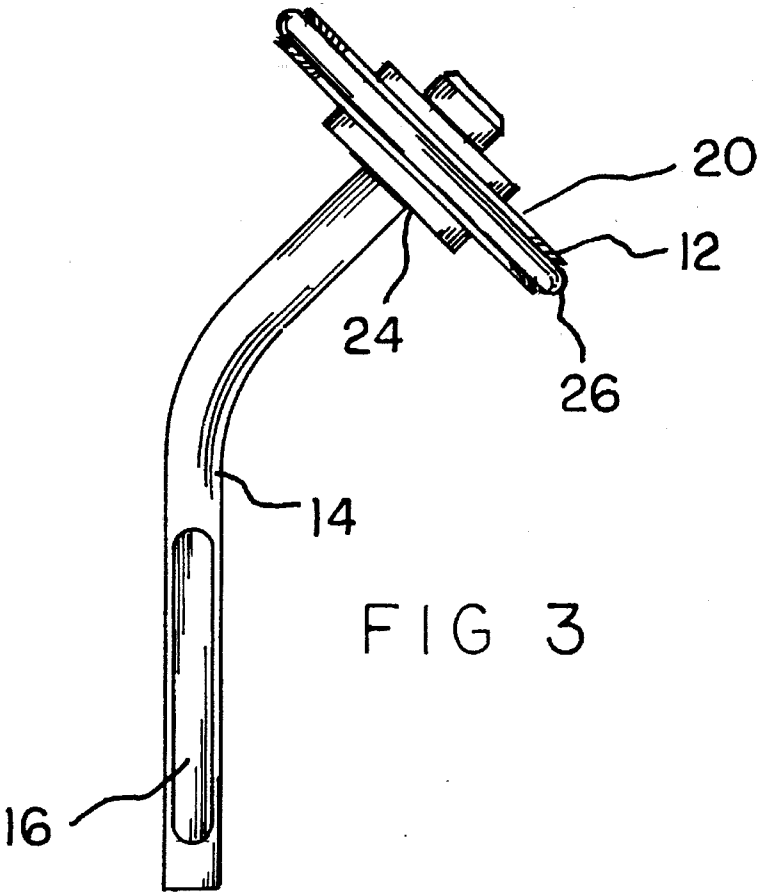
FIG. 3 is a side elevational view of one arrow guide spool shown in the prior Figures.
Figure 5:
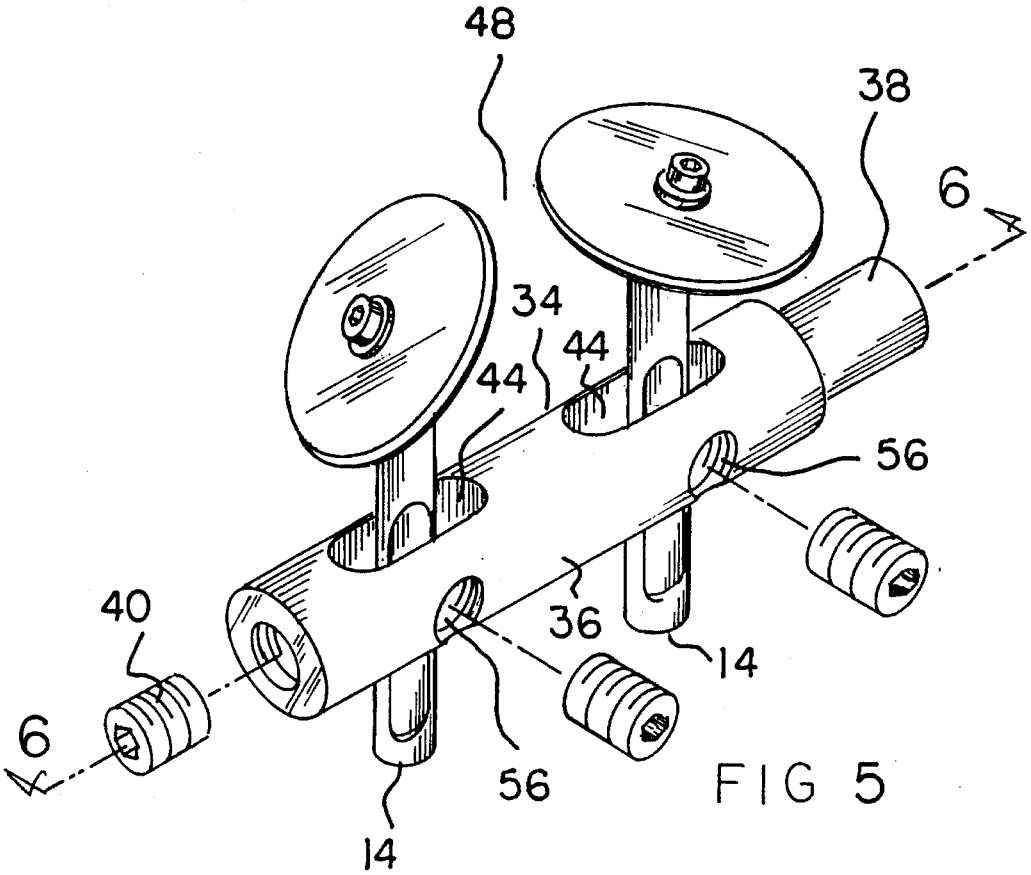
FIG. 5 is an exploded perspective view of the arrow guide spools disposed in the locator.
Figure 6:
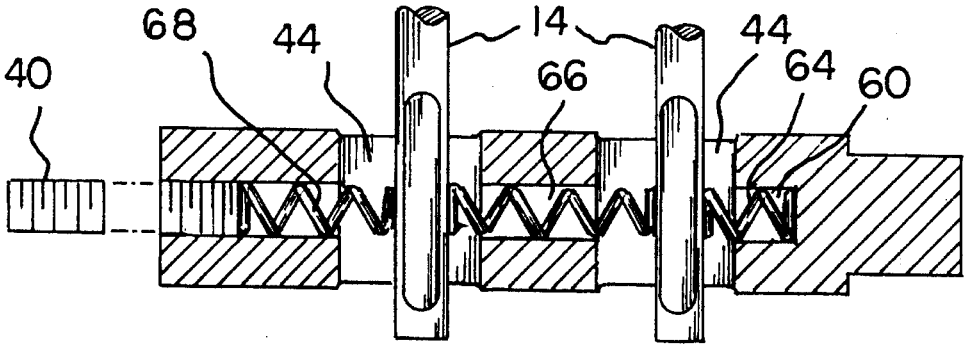
FIG. 6 is a cross-sectional view of the locator taken along line 6—6 of FIG. 5.
Figure 8:
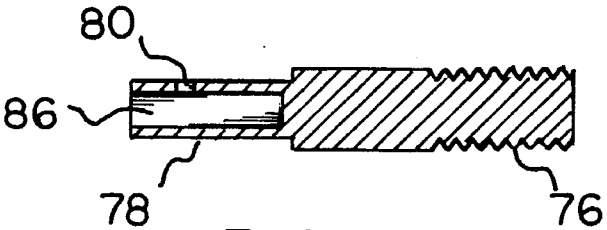
FIG. 8 is a cross-sectional view of the shaft taken along line 8—8 of FIG. 7.
Figure 7:
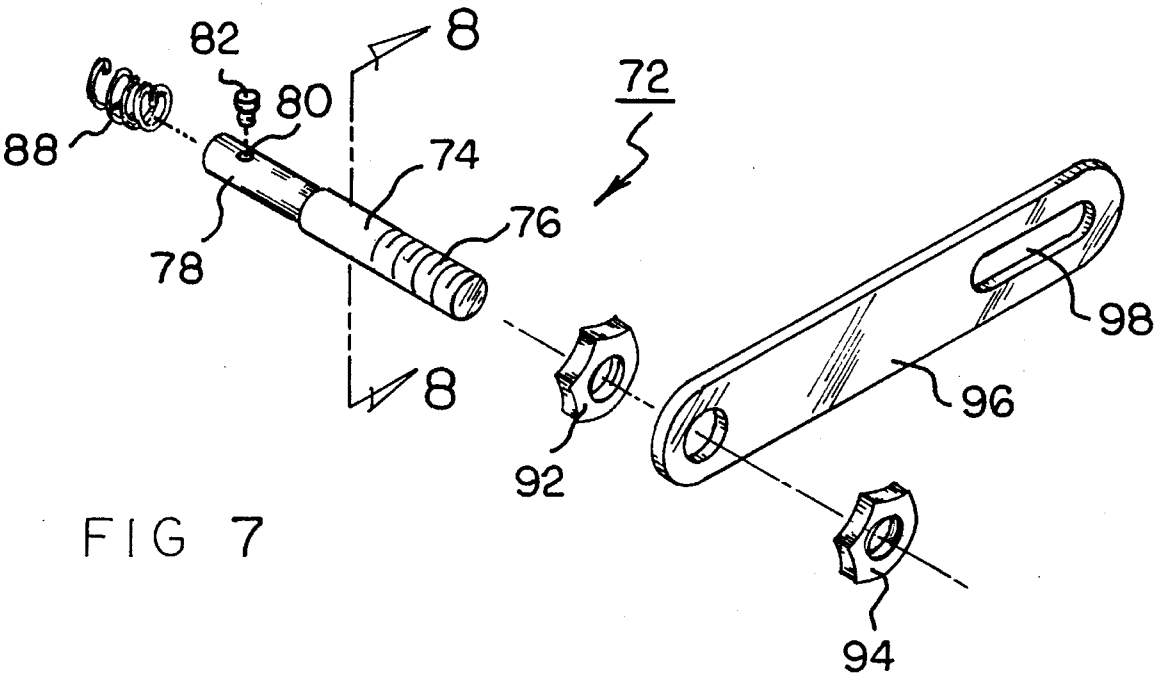
FIG. 7 is an exploded perspective view of the guide holder for coupling the adjustable arrow guide of the present invention onto the handle of a bow.

With reference now to the drawings, and in particular to FIG. 1–8 thereof, a new and improved embodying the principles and concepts of the present invention and generally designated by the reference numeral 10 will be described.

More specifically, the present invention essentially comprises a first and a second guiding spool 12. Each spool further comprises a post 14 having a top end and a bottom end, with a top leg defined between the bend and the top end, and a bottom leg defined between the bend and the bottom end. The bottom leg forms an obtuse angle with the top leg and has a flat surface 16 formed thereon. Each spool has a head 20. Each head further comprises a pulley 22, a nylon bearing 24 rotatably coupling the pulley to the top end of the post. The nylon bearing is adapted to facilitate smooth rotation of the pulley 22 about the post 14 with a minimum of friction and noise. A rubber ring 26 is coupled about the pulley and is adapted to roll along the shaft of an arrow 30.

The guide 24 includes a hollow and essentially cylindrical locator 36 having an interior surface and an exterior surface, a first end, and a second end. The first end is sealed with an integral pin 38. The pin 38 has a radial dimension less than that of the locator 36. The second end has threads formed on the interior surface and adapted for receiving a set screw 40. A pair of oval shaped guiding holes 44 extends downward through the locator 36 in a generally common direction with the bottom leg of each guiding post 14 disposed within a hole such that the bends formed on the posts of the guiding spool are facing each other and the heads of the guiding spools are positioned above the locator to define an adjustable guiding space 48 for an arrow 30 therebetween. When an arrow 30 is placed into the space 48 and then propelled therefrom, the heads of the spools 12 rotate with the moving shaft of the arrow with the fletchings 52 between the guide spools to guide the arrow with a minimum of friction and noise to maximum of arrow spool.

A pair of threaded clamping holes 56 is disposed on the locator. Each hole is positioned to be aligned with the flat surface 16 of the bottom leg of each guiding post when the bottom leg is inserted through a guiding hole. A coupling hole 60 is disposed on the locator 36 near the pin 38, with the hole adapted to receive an end of a tension spring.

A first, second, and third tension spring 64, 66 and 68 are positioned within the locator 36. The first spring 64 is positioned within the locator between the pin 38 and bottom leg of the post of the first spool. The second spring 66 positioned within the locator between the bottom leg of the post an the first spool and bottom leg of the post of the second spool. The third spring is positioned within the locator between the bottom leg of the post of the second spool and the set screw 40 which is disposed within the second end of the locator. The screw 40 is adapted for adjusting the tension on the springs within the locator, whereby adjusting the screw allows the guiding space to become smaller or larger. The device includes a pair of clamping bolts, with each bolt disposed through a clamping hole to secure the flat surface of the bottom leg of each guiding post to the locator.

The device 10 also includes a guide holder 72. The holder comprises a shaft 74 having a first end and a second end. The first end has threads 76 mounted therearound. The second end of the shaft forms a hollow cylinder 78 having a radial dimension greater than that of the pin 38 of the locator and having a recess 86 disposed therein. The recess 86 is adapted to receive a spring 88. The spring 88 is located within the recess 86 of cylinder 78 and then pin 38 is inserted into the recess and held in place by set screw 82 threaded through hole 80 in the cylinder 78. The spring 88 between the pin 38 of the locator 36 within recess 86 acts to dampen torsional movement of the locator with respect to the handle of the bow. The device also has a first nut 92 and 94 secured to the second end of the shaft.

An elongated pivot arm 96 having a first end and second end, the second end is mounted to the shaft and secured between the nuts 92 and 94 such that the arm is adjustably positioned therebetween. The first end of the arm has an elongated hole 98 disposed therethrough, with the hole adapted to be rotatably coupled to an archer's bow 102 at the handle. By rotating the arm 96, the guiding space 48 may move vertically, and by adjusting the first and second nuts 92 and 94, the guiding space 48 may move horizontally, allowing an archer having both horizontal and vertical control of the orientation of an arrow 30 placed in the guiding space 48.

One final feature of the present invention is in the use of an arrow keeping brush 106. Such brush tends to keep the arrow in place down against the guide spools 12 and 14. Although the arrow may never touch the bristles, it is used in the event that an arrow might be raised from its intended path. This is done by setting the brush 106 above the arrow and the spools. The lower end of the bristles 108 are approximately 1/32 inches. This eliminates any noise, drag or resistance. In case of an unsteady or shaky draw, the brush will be there to prevent the arrow from falling off the spools upon which they rest. Although the brush is soft enough to push an arrow in from the sides of the spool rests, it is stiff enough to keep the arrow from falling. The slot and pivot points allow for easy adjustments as shown in the various Figures. Even though the spool rests have a tapped hole in its pivot arm, there are many ways to adapt this type of arrow keeper to just about any type of spool rest.

The preferred support includes a support member 110 holding the upper edge of the bristles 108. A cross rod 112 secures the support 110 and bristles 108 in position. The opposite end of rod 112 is secured through an aperture in arm 118 through a threaded bolt 114. The lower end of the arm 118 is secured to arm 96 through a slot 120 having a bolt 122 and an associated nut extending therethrough.

After speed testing different types of spool rests, the roller spool rest as disclosed herein proved to be the fastest. It also showed great accuracy and durability. Another advantage is that the roller spool rest mounts closer to the bowstring than known rests. As such, the present arrangement acts as a mini-overdraw therefor allowing the archer to use shorter arrows for increasing speed if desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An arrow guide comprising:

a. a first and a second guiding spool, each spool further comprising:

(1) a post having a top end and a bottom end, each post further comprising:

(a) a bend between the top end and the bottom end;

(b) a top leg defined between the bend and the top end; and (c) a bottom leg defined between the bend and the bottom end, the bottom leg forming an obtuse angle with the top leg, the bottom leg having a flat surface formed thereon;

(2) a head further comprising:

(a) a pulley;

(b) a nylon bearing rotatably coupling the pulley to the top end of the post, the nylon bearing adapted to facilitate smooth rotation of the pulley about the post; and (c) a rubber ring coupled about the pulley, the ring adapted to roll along the shaft of an arrow;

b. a hollow and essentially cylindrical locator having:

(1) an interior surface and an exterior surface;

(2) a first end and a second end, the first end being sealed with an integral pin, the pin having a radial dimension less than that of the locator, the second end having threads formed on the interior surface and adapted for receiving a screw;

(3) a pair of guiding holes extending downward through the locator in a generally common direction, with the bottom leg of each guiding post disposed within a hole such that the bends formed on the posts of the guiding spool are facing each other, and the heads of the guiding spools are positioned above the locator to define an adjustable guiding space therebetween, the space adapted to receive a shaft of an arrow, whereby when an arrow is propelled through the space, the heads roll along the shaft between the fletchings with a minimum of friction and noise;

(4) a pair of threaded clamping holes disposed on the locator, each hole positioned to be aligned with the flat surface of the bottom leg of each guiding post when the bottom leg is inserted through a guiding hole;

(5) a coupling hole disposed on the locator near the pin, the hole adapted to receive an end of a spring;

(6) a first, second and third tension spring, the first spring adapted to be positioned within the interior of the locator between the pin and bottom leg of the guiding post of the first spool, the second spring adapted to be positioned within the interior of the locator between the bottom leg of the guiding post of the first spool and bottom leg of the guiding post of the second spool, and the third spring adapted to be positioned within the interior of the locator between the bottom leg of the guiding post of the second spool and the second end of the locator;

(7) a set screw coupled to the second end of the locator, the screw adapted for adjusting the tension on the springs within the locator, whereby adjusting the tension on the springs with the screw allows the guiding space to become smaller or larger, providing an archer the capability to control the guiding space based on the girth of the arrow used; and (8) a pair of clamping bolts, each bolt disposed through a clamping hole to secure the flat surface of the bottom leg of each guiding post to the locator; and c. a guide holder further comprising:

(1) a shaft having a first end an a second end, the first end having threads mounted therearound, the second end of the shaft forming a hollow cylinder having a radial dimension greater than that of the pin of the locator and having a recess disposed therein, the recess adapted to receive a spring;

(2) a spring located within the recess of the hollow cylinder, the pin of the locator being inserted into the recess and removably secured therein, the spring adapted for damping torsional movement of the locator;

(3) a first nut and a second nut, the first nut secured to the second end of the shaft; and (4) an elongated pivot arm having a first end and a second end, the second end mounted to the shaft and secured with the second nut, the first end having a hole disposed therethrough and adapted to be rotatably coupled to an archer's bow, whereby rotating the arm allows the guiding space to move vertically, and adjusting the first and second nuts allows the guiding space to move horizontally, providing an archer the capability to control the horizontal and vertical orientation of an arrow placed in the guiding space.

2. An arrow guide comprising:

a. a first and a second guiding spool each having a post, and a head adapted to rotate about the post;

b. a hollow cylindrical locator having:

(1) a first sealed end and a second end;

(2) a pair of guiding holes extending through the locator with each guiding post disposed within a hole such that the heads of the guiding spools define an adjustable arrow-receiving guiding space therebetween;

(3) tension spring including a first spring positioned within the locator between the first end of the locator and bottom end of the first guiding post, a second spring positioned within the locator between the bottom end of the guiding posts of the first and second spools, and a third spring positioned within the locator between the bottom leg of the second guiding post and the second end of the locator;

(4) means for adjusting the tension on the springs for varying the guiding space; and (5) means for securing the bottom end of each post to the locator; and c. a guide holder for coupling the locator to a bow.

3. The guide as set forth in claim 2 wherein the guide holder comprises:

a. a shaft having a first end and a second end;

b. means for adjustably coupling the first end of the shaft to the first end of the locator, whereby adjusting the coupling means between the first end of the shaft and first end of the locator moves guiding space horizontally, providing an archer the capability to control the horizontal orientation of an arrow placed in the guiding space; and c. an elongated pivot arm having a first end and a second end, the second coupled to the second end of the shaft, the first end adapted to be rotatably coupled to an archer's bow, whereby rotating the arm moves the guiding space vertically, providing an archer the capability to control the vertical orientation of an arrow placed in the guiding space.

4. The guide as set forth in claim 2 and further including:

a. a brush positionable over an arrow resting upon the guide spools and out of contact therewith and means to adustably position such brush in a predetermined orientation.

* * * * *